US009187901B2

(12) United States Patent
Ogden et al.

(10) Patent No.: US 9,187,901 B2
(45) Date of Patent: Nov. 17, 2015

(54) SELF-FURRING WELDED WIRE MESH

(71) Applicant: Tree Island Industries Ltd., Richmond (CA)

(72) Inventors: Stephen F. Ogden, Surrey (CA); Craig A. Davis, Chino, CA (US)

(73) Assignee: TREE ISLAND INDUSTRIES LTD., British Columbia (CA)

( * ) Notice: Subject to any disclaimer, the term of this patent is extended or adjusted under 35 U.S.C. 154(b) by 0 days.

(21) Appl. No.: 14/155,221

(22) Filed: Jan. 14, 2014

(65) Prior Publication Data

US 2015/0197939 A1 Jul. 16, 2015

(51) Int. Cl.

| | |
|---|---|
| ***E04C 5/01*** | (2006.01) |
| ***E04C 5/04*** | (2006.01) |
| ***E04C 5/06*** | (2006.01) |
| ***E04F 13/04*** | (2006.01) |

(52) U.S. Cl.

CPC ..... *E04C 5/04* (2013.01); *E04C 5/0627* (2013.01); *E04F 13/047* (2013.01)

(58) Field of Classification Search

CPC ..... E04C 5/03; E04C 5/04; E04C 5/0636; E04C 5/064; E04C 2/422; E04C 2/423; E04C 5/423; E04C 5/0627; E04F 13/04; E04F 13/045; E04F 13/047

USPC ..... 52/454, 343, 342, 344, 660, 663, 664, 52/649.1

See application file for complete search history.

(56) References Cited

U.S. PATENT DOCUMENTS

| | | | | | |
|---|---|---|---|---|---|
| 553,306 | A * | 1/1896 | Fordyce | 52/669 |
| 617,458 | A * | 1/1899 | Clancy | 52/660 |
| 659,416 | A * | 10/1900 | Perry | 52/669 |
| 749,714 | A * | 1/1904 | Barnes et al. | 245/11 |
| 1,986,172 | A * | 1/1935 | Wilson | 52/520 |
| 2,565,292 | A * | 8/1951 | Arthur | 105/375 |
| 3,299,785 | A * | 1/1967 | James | 404/4 |
| 3,342,003 | A * | 9/1967 | Frank | 52/664 |
| 3,475,876 | A * | 11/1969 | Oroschakoff | 52/581 |
| 3,672,022 | A * | 6/1972 | York | 428/593 |
| 3,991,536 | A * | 11/1976 | Rutherford | 52/661 |
| 4,003,178 | A * | 1/1977 | Douthwaite | 52/664 |
| 4,245,926 | A * | 1/1981 | Asszonyi et al. | 405/150.1 |
| 4,693,048 | A * | 9/1987 | Guetersloh | 52/664 |
| 5,287,673 | A * | 2/1994 | Kreikemeier | 52/664 |
| 5,522,194 | A * | 6/1996 | Graulich | 52/309.4 |
| 5,540,023 | A * | 7/1996 | Jaenson | 52/343 |
| 6,149,701 | A * | 11/2000 | Ellingson | 55/493 |
| 6,305,432 | B1 * | 10/2001 | Sacks et al. | 139/425 R |

(Continued)

*Primary Examiner* — James Ference

(74) *Attorney, Agent, or Firm* — Holland & Knight LLP; Richard E. Lyon, Jr.

(57) ABSTRACT

A welded wire mesh for reinforcing generally planar concrete and stucco structures. The mesh is formed of a matrix of longitudinal and transverse wires disposed about a first common plane and welded together at their intersections. A selected plurality of the longitudinal wires define a plurality of generally V-shaped spacing furrs therein extending generally perpendicular to the first plane with the bottoms of the furrs being disposed in a second plane spaced from the first plane a distance substantially equal to one-half of the predetermined thickness of the panel. The spacing furrs are positioned so as to be longitudinally and transversely staggered along the mesh and are formed by pushing portions of the selected longitudinal wires perpendicular to the axes of the wires while holding upstream portions thereof in a fixed disposition so as to form the furrs without thinning and weakening the wires along the spacing furrs.

6 Claims, 7 Drawing Sheets

(56) References Cited

U.S. PATENT DOCUMENTS

| | | | | |
|---|---|---|---|---|
| 8,132,385 | B2 * | 3/2012 | Phillips et al. | 52/660 |
| 8,291,670 | B2 * | 10/2012 | Gard et al. | 52/662 |
| 2003/0029120 | A1 * | 2/2003 | Sacks et al. | 52/660 |
| 2004/0134158 | A1 * | 7/2004 | Farrell et al. | 52/664 |
| 2005/0055949 | A1 * | 3/2005 | Sacks et al. | 52/633 |
| 2005/0055953 | A1 * | 3/2005 | Sacks et al. | 52/633 |
| 2005/0257471 | A1 * | 11/2005 | Stevens | 52/443 |
| 2007/0175145 | A1 * | 8/2007 | Sacks et al. | 52/408 |
| 2012/0247047 | A1 * | 10/2012 | Ogden | 52/454 |

* cited by examiner

SELF-FURRING WELDED WIRE MESH

BACKGROUND OF THE INVENTION

The present invention relates to metal reinforcing mesh used in generally planar concrete panels and slabs. More particularly, it relates to an improvement in such mesh that ensures the mesh will be embedded to the correct depth in the concrete panel or slab. Typically, wire mesh products comprise pluralities of smooth or deformed longitudinally and transversely extending wires forming a plurality of rectangles, squares or hexagons. The wire generally is twisted, welded or otherwise fastened together at the intersections of the longitudinal and transverse wires. Examples of such products include welded concrete reinforcing mesh, welded utility mesh and welded stucco reinforcing lath.

It is common practice in concrete reinforcing products such as rebar and welded wire mesh to add separate supports or spacing elements, also known as furring elements or spacing furrs, to the wires at several locations about the mesh in order to position the mesh during the pouring of the concrete in the panel forming process proximate the center of the cross-section of the concrete panel or slab or other generally planar concrete structure (hereinafter collectively referred to as panels). A variety of different furring elements, including small pieces of concrete, have been attached to the wires in the mesh for this purpose. While generally achieving their intended purpose, such elements add to the material cost of the panel and their securement to the wires is labor intensive, further increasing the cost of construction.

In an effort to reduce costs, wire mesh has been developed in which the individual wires themselves define spacing furrs at uniformly spaced intervals along the vertical or transverse wires that extend across the lathing material between pairs of longitudinally or horizontally extending wires. The spacing furrs were formed by bending the transverse wires such that they defined generally U-shaped troughs spaced apart between the longitudinally extending wires. In use, the bases or flat bottoms of the troughs collectively provided support for the wire mesh and spaced the remainder of the transverse wires and the non-deformed longitudinal wires, which are welded thereto, at a predetermined elevation above the collective bases of the spacing furrs, thereby effectively elevating the level of the majority of the mesh above the bases of the furrs. Thus, when the concrete is poured over the wires, the majority of the mesh will be approximately centered in the resultant panel. Such a configuration is disclosed in U.S. Pat. No. 7,287,356.

While the above-described mesh configuration does eliminate the need for separate supporting or furring elements, the bending of the wire to form the generally U-shaped spacing furrs thins the wire along the bends formed therein and in so doing, weakens the structural integrity of the individual wires along their deformed portions. The bending and resultant thinning of the wires also further weakens the overall mesh structure due to the longitudinal alignment of the deformations (spacing furrs) in the vertical strands that is commonly employed in this type of reinforcing mesh to facilitate construction. The mesh of the present invention and its method of manufacture obviates these shortcomings in the prior art. The mesh of the present invention also would be suitable for stucco reinforcing wherein the mesh also should be centered in the stucco.

SUMMARY OF THE INVENTION

The present invention is directed to an improved welded wire mesh of the type used to reinforce generally planar concrete and stucco structures and to methods for forming the mesh. The mesh of the present invention comprises a matrix of longitudinally and transversely extending wires extending parallel to and disposed about a common first plane that are welded together at the points of intersection. A selected plurality of said longitudinally extending wires define generally V-shaped depending spacing furrs therein with the bottoms of the Vs defined by the spacing furrs lying in a second common plane below the first plane. The spacing between the planes is predetermined such that upon placing the welded mesh in a forming frame of a given depth so that the bottoms of the furrs about the bottom of the frame and then filling the frame about the mesh with concrete, the first plane containing the great majority of the wire mesh will be disposed at the approximate midpoint of the concrete so as to locate the great majority of the mesh at the midpoint of the resultant concrete panel. In stucco reinforcing applications, the spacing between the two planes would be equal to one half the thickness of the stucco to be applied about the mesh.

The spacing furrs in the selected longitudinally extending wires are preferably formed such that the furrs in at least the proximately disposed selected longitudinal wires are misaligned in the transverse direction so as to be longitudinally staggered and each of the selected longitudinally extending wires is disposed between at least one, and preferably two, longitudinally extending wires which are devoid of any furrs, thereby effecting a staggering of the spacing furrs in both the longitudinal and transverse directions. It also is preferable that at least two transversely extending wire extends between the spacing furrs in each of the selected longitudinally extending wires so that two spacing furrs are not adjacent to each other in a single wire. In addition, during the forming of the spacing furrs, additional wire is fed into the furrs so as to avoid deforming or breaking the longitudinally selected wires or even thinning the wires along the spacing furrs formed therein.

In a preferred process for forming the self-furring reinforcing mesh of the present invention, the desired matrix of longitudinal and transverse wire is formed by moving a parallel array of laterally spaced longitudinally extending wires along a forming station. The transverse wires are individually fed onto the moving array of wires in spaced intervals and sequentially welded to the longitudinal wires at the intersections therewith as the spacing furrs are formed in selected longitudinal wires behind the welds. A plurality of adjustable pusher assemblies and welding heads are employed in the forming station, preferably in laterally aligned and longitudinally adjacent pairs, such that a welding head and pusher assembly are adjacent to each other and to each of the longitudinally extending wires in the mesh for welding the transverse wires to the longitudinal wires and forming the spacing furrs in the selected longitudinal wires as the wires are moved along the forming station.

The individual pushing assemblies and welding heads preferably are moveably mounted in the forming station, both longitudinally and laterally, so that they can be properly positioned to form the spacing furrs at the desired locations along each of the selected wires and to accommodate variations in the size of the mesh and/or in the matrix defined by the mesh, i.e., the spacing between the intersections for different applications. Upon activation, a pusher assembly grips and holds in place a downstream portion of the adjacent selected wire while pushing a proximate upstream portion of the wire in a direction normal to the central axis of the wire. The assembly also maintains the upstream and downstream portions of the wire in axial alignment so that as the wire is pushed normal to its central axis while the downstream portion of the wire is held stationary, the wire is moved outwardly and into a generally V-shaped configuration while pulling an upstream portion of the wire into the forming furr, thereby forming the V-shaped furr without stretching and thinning the wire along the furr as would occur if the furr were formed by simply bending the wire in a conventional manner.

By effectively adding more material (wire) to the furrs as they are being formed, damage to the selected longitudinally extending wires is prevented and the strength of the individual wires and the overall mesh is not significantly degraded by the formation of the spacing furrs. By providing an adjustable pushing assembly and welding head for each longitudinally extending wire in the mesh, the size of the mesh and number and location of the spacing furrs to be formed in the mesh can be readily varied for different applications thereby providing a highly efficient process for producing the improved mesh of the present invention.

DETAILED DESCRIPTION OF PREFERRED EMBODIMENTS OF THE PRESENT INVENTION

Figure 1:
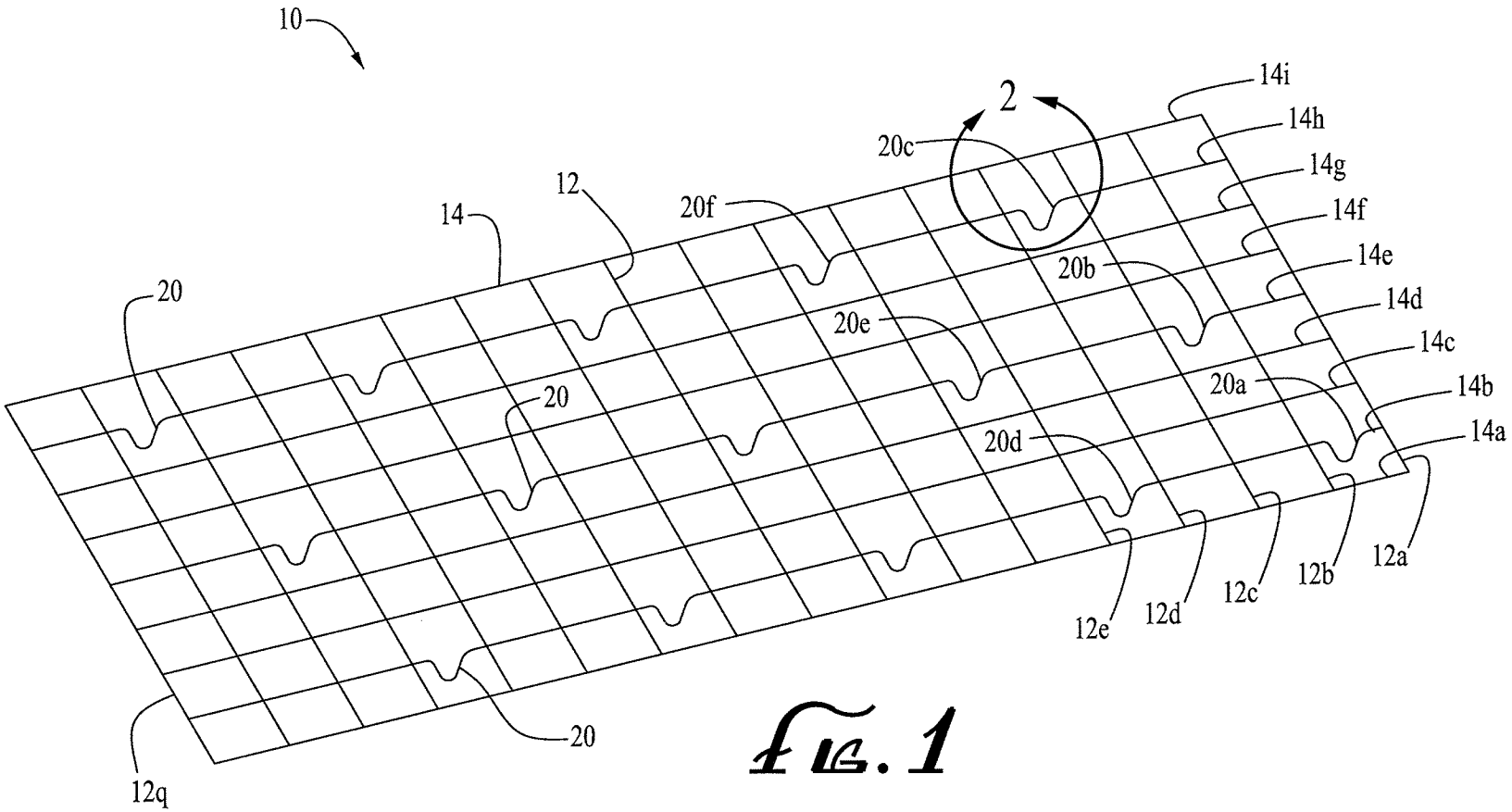
FIG. 1 is a perspective view of a preferred embodiment of the self-furring welded wire mesh of the present invention.
Figure 2:
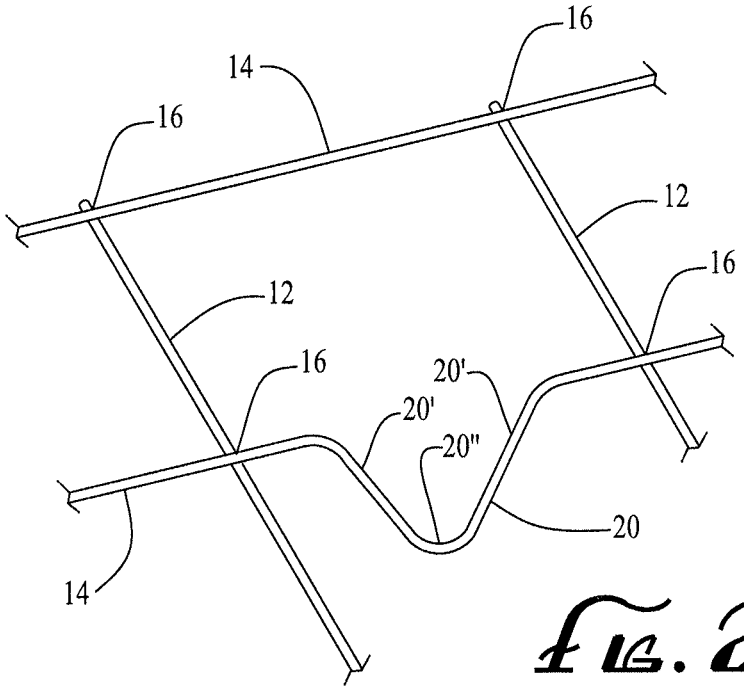
FIG. 2 is a cross-section of the preferred configuration of the self-furring welded wire mesh of the present invention taken along line 2 in FIG. 1.
Figure 3:
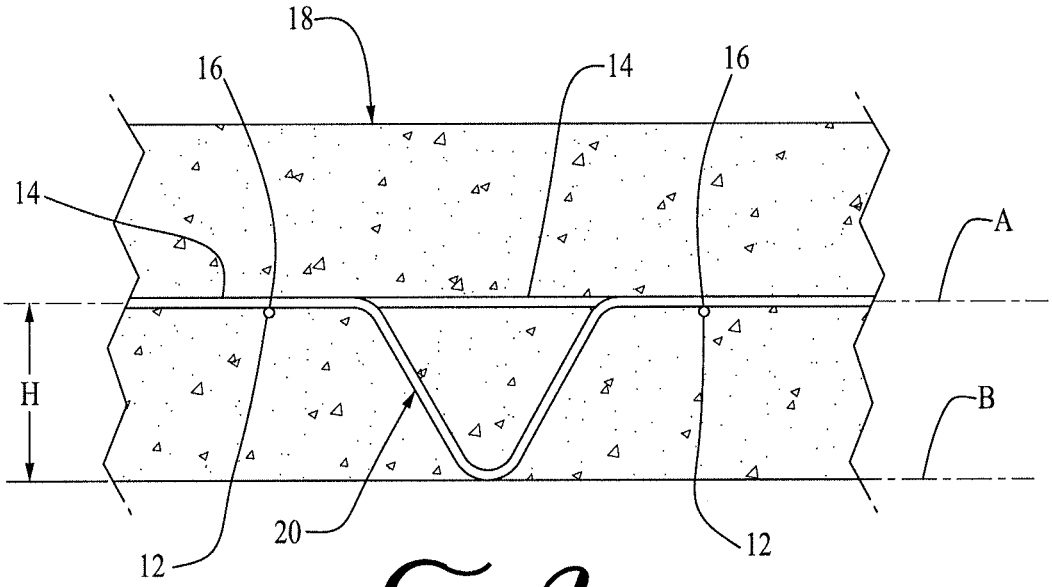
FIG. 3 is a cross-section of a concrete panel with the self furring welded wire mesh of the present invention embedded therein.

A preferred embodiment of the self-furring welded wire mesh 10 of the present invention is illustrated in FIGS. 1-3. The mesh 10 comprises a plurality of spaced transversely extending wires 12 and a plurality of longitudinally extending wires 14, also known as line wires, intersecting at right angles to define a square matrix as illustrated in the drawings. The transverse wires 12 and longitudinal wires 14 extend parallel to and are substantially disposed about a common horizontal plane A (see FIG. 3) and are welded together at their points of intersection 16 to define the mesh 10. The spacing between intersections 16 can vary depending on the size and material of which the individual wires are formed and the particular application for which the mesh is to be used. By way of example only, a typical concrete panel approximately 4-6 in. deep could include a mesh 10 formed of 10-4 gauge, stainless steel wire and define a matrix 4 in. by 4 in. square.

To space the mesh 10 proximate the midpoint of a concrete panel 18, as shown in FIG. 3, a plurality of spacing furrs 20 are formed in selected longitudinal wires, e.g. wires 14*b*, 14*e* and 14*h* (See FIG. 1). The spacing furrs 20 are preferably generally "V" or "U"-shaped, having inclined side wall portions 20' and rounded bottoms 20" (hereinafter referred to as generally V-shaped. The furrs project perpendicularly from plane A and are similarly sized in a given mesh such that the rounded bottoms 20" of the spacing furrs 20 lie in a second common plane B (see FIG. 3). The furrs each define a height H which is formed so as to be substantially equal to one half the thickness of the concrete panel in which they will be embedded (see FIG. 3).

In the formation of the concrete panel 18, the mesh 10 is inserted into a frame (not shown) with the bottoms 20" of the furrs being disposed adjacent to the bottom of the frame and the frame is then filled with concrete. By making the height H of the spacing furrs substantially equal to one-half of the thickness of the panel and positioning the bottoms of the spacing furrs against the bottom of the frame, the transverse wires 12 and at least the majority of the longitudinal wires 14 will be positioned at the midpoint of the concrete panel, maximizing the support for the concrete. Also, the spacing furrs preferably are generally uniformly spaced along the individual selected longitudinally extending wires such that the spacing furrs 20 are staggered both longitudinally and transversely about the mesh and adjacent furrs in the same wire are avoided, as illustrated in FIG. 1. Also, the outermost longitudinal wires, i.e. wires 14*a* and 14*i* in mesh 10, (see FIG. 1), preferably do not contain any spacing furrs. The wires 12 and 14 used to make the mesh 10 can be of any suitable material including bright, galvanized, plated or coated iron, carbon or alloyed steel or of aluminum, stainless steel, brass or other non-ferrous material or non-metallic material.

The preferential avoidance of spacing furrs 20 in the outermost longitudinal wires provides enhanced structural integrity for the lateral ends of the mesh. Staggering the spacing furrs both longitudinally and transversely and avoiding adjacent spacing furrs in longitudinally selected wires also avoids weakening the mesh by the addition of the spacing furrs as does the manner in which the furrs are formed. For example, in the mesh 10 illustrated in FIG. 1, the leading end of the mesh is defined by transverse wire 12*a* and the rearward end is defined by transverse wire 12*q*. The forward most spacing furr 20*a* is disposed in longitudinal wire 14*b* between the leading end of the mesh, defined by transverse wire 12*a*, and transverse wire 12*b*. Moving rearwardly along the mesh, the next spacing furr 20*b* is disposed in longitudinal wire 14*e* between transverse wires 12*b* and 12*c*. The next spacing furr 20*c* is disposed between in longitudinal wire 14*h* and transverse wires 12*c* and 12*d* and the fourth spacing furr 20*d* is disposed in longitudinal wire 14*b* between transverse wires 12*d* and 12*e* and is longitudinally aligned with spacing furr 20*a* and the pattern continues to repeat. Through such a pattern and given the size and configuration of the illustrated mesh 10, the spacing furrs are misaligned as viewed in the transverse direction and preferably staggered longitudinally, particularly in proximately located longitudinally extending wires as illustrated, to provide an even distribution of the furrs.

In the illustrated mesh 10, as again viewed transversely, each grouping of three furrs (e.g. 20*a*, 20*b* and 20*c*) places one furr in the middle (20*b*), one to the left (20*c*) and one to the right (20*a*). If the mesh were longer in the transverse direction, the illustrated pattern could simply repeat or partially repeat. Also, the furrs are staggered transversely in that each of the selected longitudinally extending wires 14*b*, 14*e* and 14*h* is transversely adjacent to two longitudinally extending wires devoid of furrs. Selected wire 14*b*, for example, is adjacent to wires 14*a* and 14*c*. Selected wire 14*e* is adjacent to longitudinally extending wires 14*d* and 14*b*. The term "longitudinally and transversely staggered" is used herein to define such a configuration. Such staggering of the spacing furrs further enhances the distribution of the furrs about the mesh. Lastly, no two spacing furrs in any one of the selected longitudinal wires 14*b*, 14*e* or 14*h* are adjacent to each other.

While the pattern of the spacing furrs can vary depending on a variety of factors, including the size and spacings of the wires, the size of the mesh and its application, it is generally preferable to avoid transverse alignment of spacing furrs in adjacent longitudinal wires, to minimize transverse alignment by proximate longitudinal wires to avoid spacing furrs in adjacent longitudinally extending wires and to avoid adjacent spacing furrs in a single selected longitudinal wire. As a result, the furrs are relatively evenly distributed about the mesh and concentrations of the furrs laterally and longitudinally are avoided, enhancing the structural strength of the mesh, evenly distributing the support for the concrete and minimizing the use of material.

To further enhance the structural integrity of mesh 10, it is highly desirable to minimize the thinning of the wire in the formation of the spacing furrs 20 as such deformation can be deleterious to the structural integrity of the mesh. It is this degradation of the integrity of the mesh that can occur if the spacing furrs 20 were formed by simply bending the selected longitudinal wires to define the furrs. To create the spacing furrs 20 in the selected longitudinal wires without causing the deleterious thinning of the selected wires or otherwise damaging or weakening the wire, Applicant effectively adds additional material to the wire along the spacing furrs during the forming thereof to provide a relatively constant diameter wire throughout the entire length thereof, including the spacing furrs formed therein.

Figure 5:
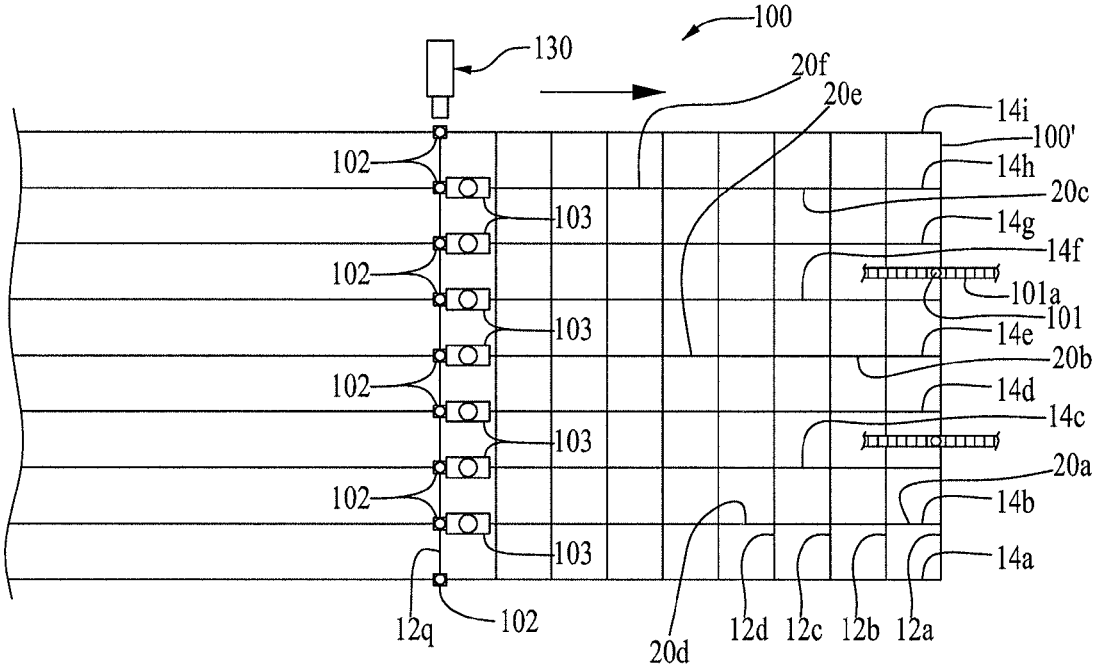
FIG. 5 is a schematic plan view of a station for forming the self-furring welded wire mesh of the present invention with the forming mesh shown disposed thereover.

In a preferred mesh forming process, the longitudinal wires 14*a*-14*i* are arranged in a laterally spaced array on the forming station 100. A plurality of welding heads 102 and pushing assemblies 103 are moveably mounted in the forming station, preferably in longitudinally adjacent pairs and in transverse alignment, with a welding head 102 and an associated pushing assembly 103 being adjacent to and in longitudinal alignment with each of the longitudinally extending wires 14. See, e.g., FIG. 5. A leading transverse wire 12*a* is welded to the leading end portion of the parallel array of longitudinal wires and the array of wires is then pulled by the leading transverse wire 12*a* in the longitudinal direction along the forming station 100 (left to right, as shown in FIG. 5). This can be accomplished by a variety of different mechanisms. For example, one or more raised fingers 101 carried by one or more drive chains 101*a* can be employed proximate the downstream end 100' of the forming station that engage the lead transverse wire 12*a* and move longitudinally along the station, pulling the array of wires. One or more rotatable gears (not shown) also could be utilized to engage transverse wire 12*a* and move the forming mesh along the station. Other conventional moving means also could be employed.

As the array of wires are moved along the forming station, the transverse wires are fed periodically onto the longitudinal wires and through the selected positioning and activation of the welding heads and associated pushing assemblies, the transverse wires are welded to the longitudinal wires at predetermined spacings and the spacing furrs are formed at the desired locations in the selected longitudinal wires. It is to be understood that the formation of a mesh 10 as shown in the drawings comprising nine longitudinal wires (14*e*-14*i*) is for illustration purposes only and that the number and spacing of the longitudinal wires and of the transverse wires can vary depending on the size of the mesh, the size of the wire comprising the mesh and its intended application.

Each pushing assembly 103 preferably is associated with a welding head 102 of the type commonly used in forming conventional wire reinforcing mesh, such as the welding heads marketed by Schlatter Deutschland GmbH & Co. KG of Munster, Germany. Each pushing assembly is positioned downstream of the adjacent welding head and, as noted earlier, is adjacent to one of the longitudinally extending wires 14. Each pushing assembly preferably comprises a pusher 104, a wire gripping mechanism 106 and a wire guide 108. The pusher 104 is mounted for reciprocal movement in a vertical direction between the wire gripping mechanism 106 which is downstream of the pusher 104 and the guide 108 which maintains the portion of the adjacent wire upstream of the pusher in axial alignment with the portion of the wire downstream of the pusher.

Figure 4B:
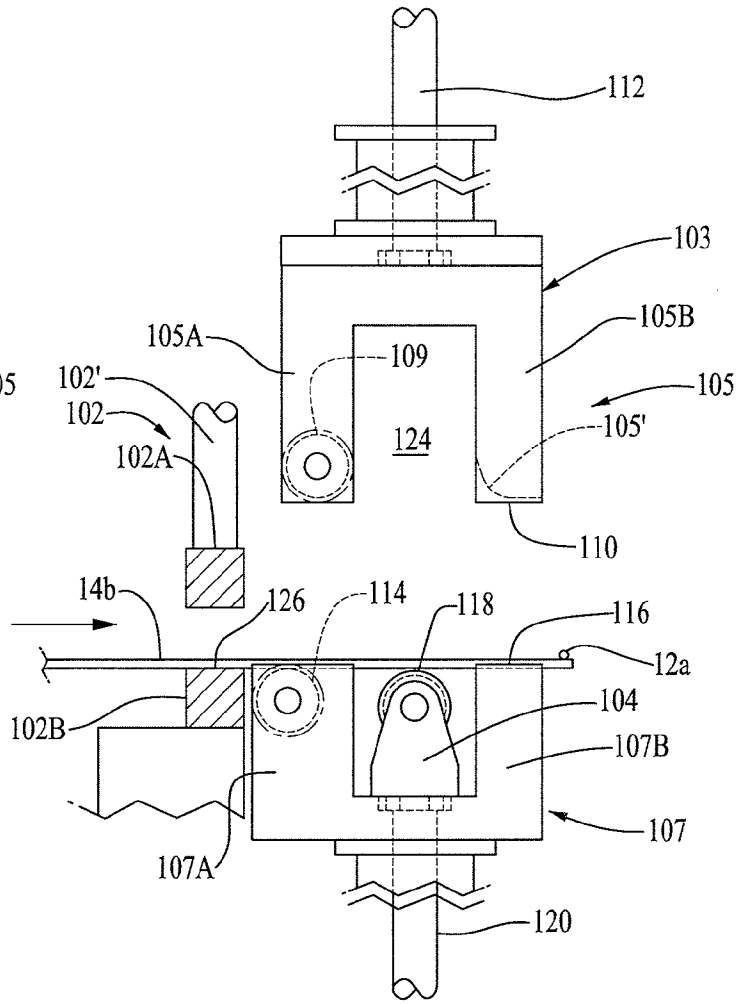
FIGS. 4A-4F are a series of schematic side views of a welding head and pushing assembly forming a spacing furr in a selected longitudinal wire and welding a transverse wire in place during the formation of the welded wire mesh of the present invention.
Figure 4A:
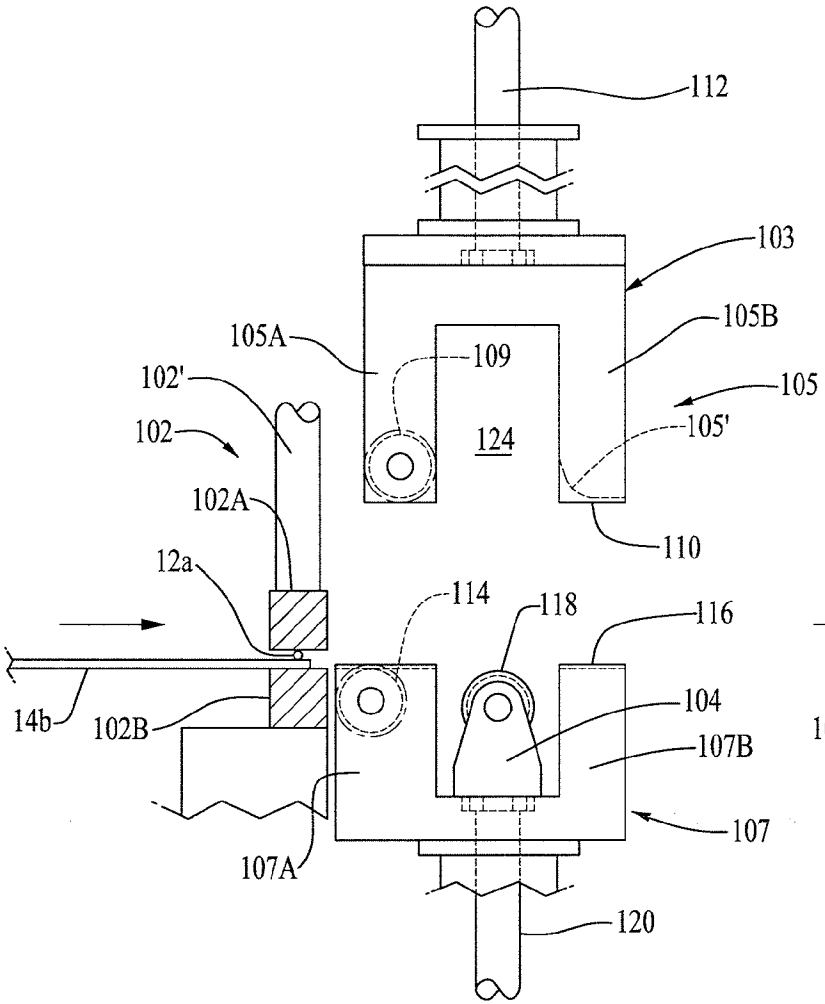
Figure 4D:
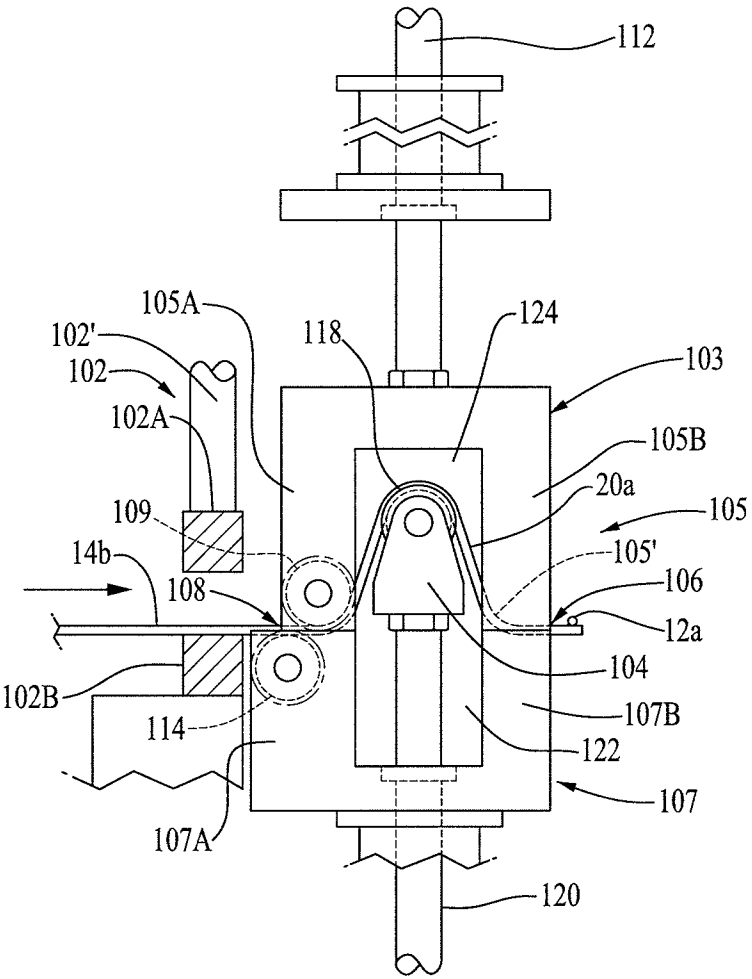
Figure 4C:
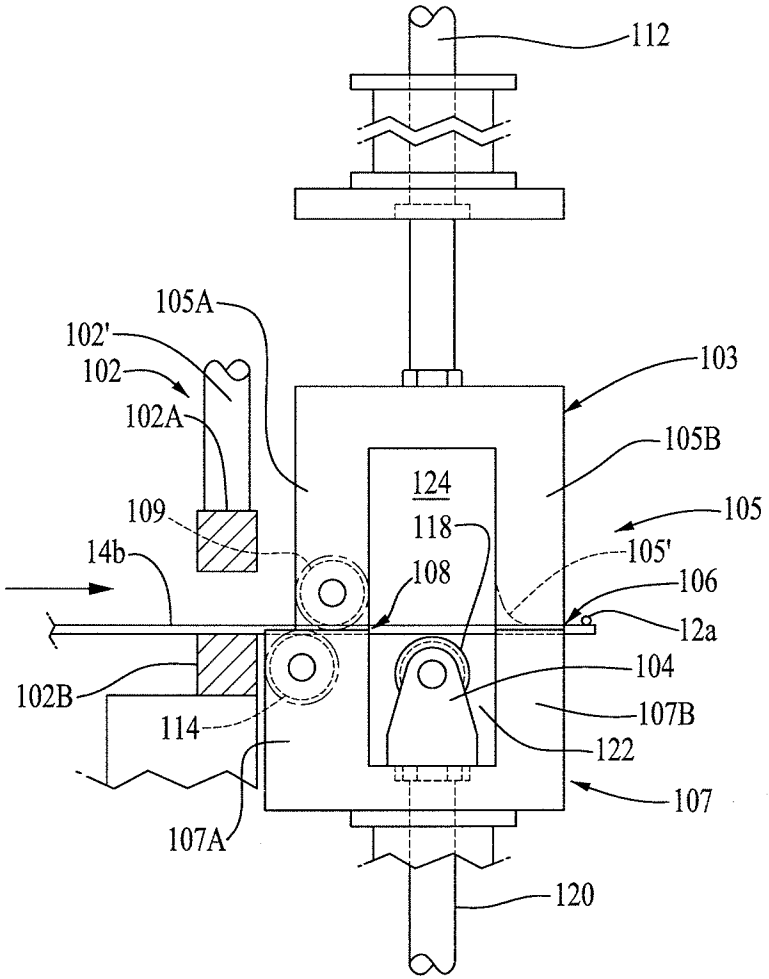
Figure 4F:
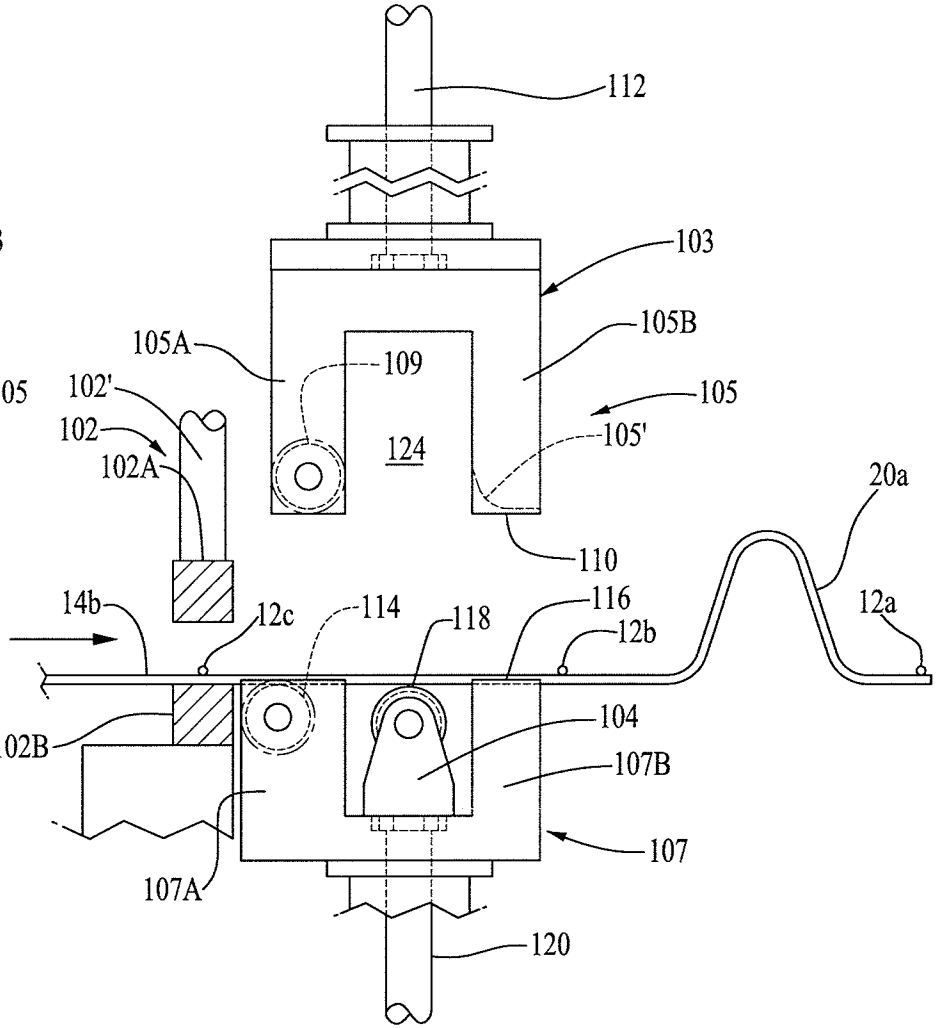
Figure 4E:
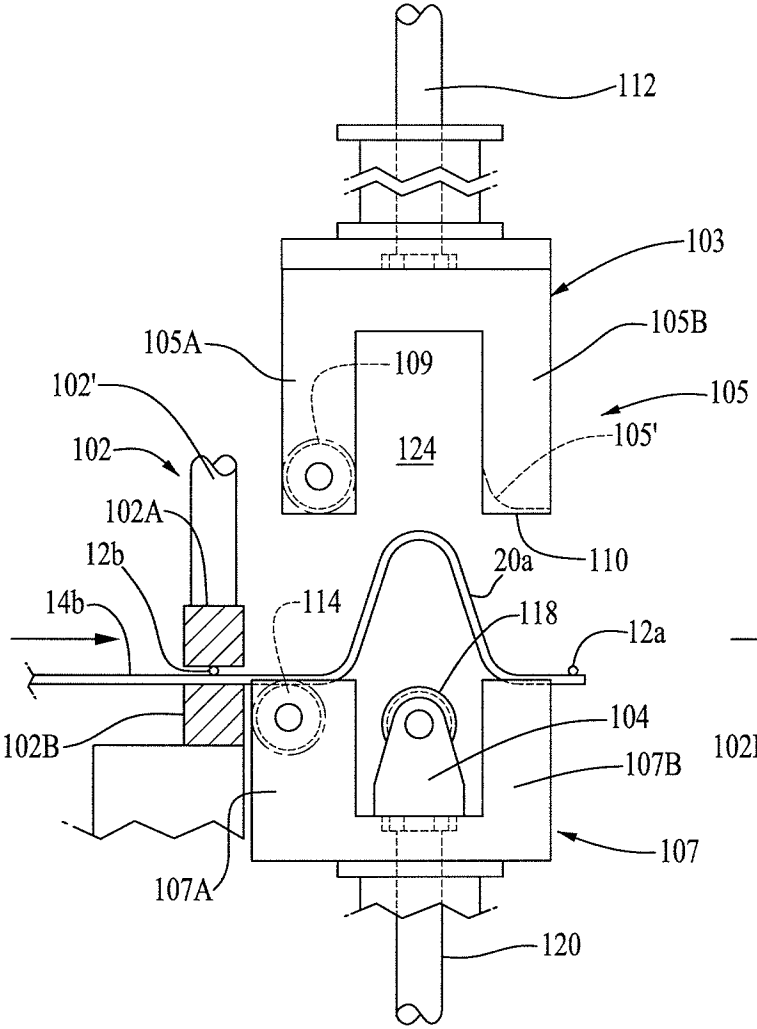

Upon activation of a pusher assembly 103, the gripping mechanism 106 on the assembly will grip a portion of the adjacent longitudinal wire downstream of the pusher 104 and the pusher will move in a vertical direction with the downstream portion of the wire being held in a fixed disposition by the gripping mechanism 106. As the pusher moves vertically, it engages the wire disposed thereover and forces the wire into an inverted generally V-shaped configuration as illustrated in FIGS. 4C and 4D. As the wire is pushed into the generally V-shaped configuration, the portion of the wire upstream of the pusher is pulled through the wire guide 108 into the forming V, effectively allowing additional material (the wire) to be added to the spacing furr as it is formed (see FIG. 4D). By selective location and activation of the pusher assemblies 103, the spacing furrs 20 can be formed in the selected longitudinal wires and at predetermined spacings to achieve the desired staggering of the spacing furrs about the mesh. In addition, the pulling of selected longitudinal wires through their respective guides 108 as the pusher assemblies form the spacing furrs, avoids breaking the wire as well as any deleterious deformation or stretching and thinning of the wire during the formation of the furrs.

In a preferred configuration, the pushing assembly 103 comprises an upper portion 105 and a lower portion 107. The upper portion is of an inverted U-shaped configuration defining depending aligned leg portions 105A and 105B. The upstream leg portion 105A carries a guide wheel 109, preferably in the form of a pulley, freely rotatable, in the lower end thereof. The downstream leg portion 105B defines a wire gripping surface 110 at the lower end thereof and an inner radiused surface 105' defining a radius of curvature equal to the radius of curvature defined by guide wheel 109. By way of example only, a radius of about 0.375 in. has been utilized. The upper portion 105 of the pushing assembly is carried by a plunger 112 and mounted for reciprocal movement in the vertical direction whereby the upper portion of each of the pushing assemblies can be selectively moved into and out of operative engagement with the longitudinally extending wire 14 disposed thereunder.

The lower portion 107 of each pushing assembly 103 is of a U-shaped configuration and defines leg portions 107A and 107B which are vertically and longitudinally aligned with the leg portions 105A and 105B of the upper portion of the pusher assembly. The upstream leg portion 107A preferably carries a freely rotatable guide wheel 114 in the upper end thereof preferably of the same pulley-shaped configuration and having the same radius as the upper guide wheel 109 in leg portion 105A, but is longitudinally offset in the upstream direction therefrom as seen in FIGS. 4A-4F. So positioned, when the upper portion 105 of the pusher assembly 103 is in the extended or lower position, as illustrated in FIGS. 4C and 4D, the guide wheel 109 carried thereby cooperates with the guide wheel 114 on the lower portion of the assembly to define a low friction line guide 108. The downstream leg 107B defines a wire gripping surface 116 at the upper end thereof configured to cooperate with gripping surface 110 in the upper leg portion 105B to grip a downstream portion of the longitudinal wire 14 disposed therebetween, as will be described. In a preferred configuration, the wire gripping surfaces 110 and 116 define opposed outwardly tapered V-shapes so as to be able to firmly hold a portion of a wire therebetween without deforming the wire. While a solid pusher could be used, the pusher 104 also is preferably provided with a freely rotatable wheel 118 at the extended end thereof, also preferably formed in a pulley configuration, and is carried by a plunger 120 in the lower portion 107 of the pushing assembly whereby the pusher can be reciprocally moved in a vertical direction between a retracted position in the cavity 122 defined by the lower portion 107 of the pushing assembly and an elevated position within the cavity 124 defined by the upper portion 105 of the pusher assembly (as illustrated in FIGS. 4C and 4D).

The weld head 102 associated with each pusher assembly is positioned substantially adjacent to the upstream side of the pusher assembly and comprises an upper portion 102A and a lower portion 102B with the lower portion of the weld head defining an upper line support surface 126 adjacent to and lying in a common plane with the lower guide wheel 114 and the gripping surface 116 on the downstream end of the lower portion 107 of the pusher assembly. The upper portion 102A of the welding head 102 is carried by a plunger 102' and is mounted for reciprocal vertical movement so as to be moveable into and out of welding contact with a transverse wire 12 disposed atop a longitudinal wire 14 extending across and supported by the lower portion 102B of the welding head, guide wheel 114 and gripping surface 116, as illustrated in FIG. 4B.

In operation, the parallel array of longitudinal wires 14 is first positioned on the forming station as above described with the pushing assemblies and adjacent welding heads being laterally aligned thereon (see FIG. 5). A transverse wire 12*a* is first positioned across the lateral array of longitudinal wires 14*a*-14*i* such that the transverse wire is located on the transversely aligned lower welding head portions 102B. So positioned, the wire rests atop and intersects all of the longitudinally aligned wires at right angles. The upper welding heads are then collectively moved downwardly onto the transverse wire 12*a*, current is applied to the upper and lower welding heads and the first transverse wire 12*a* is welded in place (see FIG. 4A). The upper welding heads are then raised to the retracted position and the array of wires is then moved forwardly a predetermined distance over the forming station 100 by a suitable drive mechanism 101*a* operatively connected to the indexing finger(s) 101, or other suitable means for advancing the forming matrix of wires over the forming station, until the transverse wire 12*a* clears the laterally aligned pusher assemblies as illustrated in FIG. 4B. The pusher assembly 103 positioned adjacent to the first selected longitudinal wire (14*b* in mesh 10) is then activated, lowering the upper portion 105 thereof into the operative position whereupon longitudinal wire 14*b* extends across the upper support surface 126 of the lower portion 102B of the weld head, between guide wheels 109 and 114, adjacent to rotatable wheel 118 in the extended end of the pusher 104 and between gripping surfaces 110 and 116 in the extended ends of the leg portions 105B and 107B of the pusher assembly. So positioned, the gripping surfaces 110 and 116 bear against the portion of wire 14*b* disposed therebetween which is downstream of and proximate the pusher 104 (see FIG. 4C). The pusher 104 is then activated forcing a portion of wire 14*b* upwardly as illustrated in FIG. 4D. As the wire 14*b* is urged upwardly, the portion of the wire 14*b* disposed between the two gripping surfaces 110 and 116 is held in a stationary position and the adjacent upstream portion of the wire is caused to bend about the upper guide wheel 109 in the upstream leg portion 105 of the pusher assembly, about the rotatable wheel 118 in the extended end of the pusher assembly and about the interiors radiused surface 105' in leg portion 105B. Concurrently, additional wire is drawn downstream and into forming V-shaped furr between the aligned upper and lower guide wheels 109 and 114, thereby forming the furr without stretching or otherwise deforming or damaging the wire.

After the first spacing furr 20*a* is formed in the wire 14*b*, pusher 104 and the upper portion 105 of the pusher assembly 103 are retracted (see FIG. 5F) and a second transverse wire 12*b* is fed into position across the longitudinally spaced wires directly over the lower portion of the welding heads, the upper portions of the welding heads are concurrently lowered into position (see FIG. 4F) and the transverse wire 12*b* is welded in place. The upper portions of the welding heads are then raised and the drive mechanism is activated to advance the forming mesh to the next location where another transverse wire 12*c* is fed into place between the upper and lower portions of the welding heads and then welded to wires 14 (see FIG. 4F). The pusher assembly 103 adjacent longitudinal wire 14*e* is then activated as above-described, to form the next spacing furr 20*b* in wire 14*e* and the process continues until the desired length of mesh is formed. While a variety of means can be utilized to insert the transverse wires across the array of longitudinal wires at right angles with respect thereto and directly over the lower welding heads, a conventional wire feeding mechanism 130 employed in wire mesh forming assemblies, such as those marketed by Schlatter Deutschland, has proved suitable for such purposes.

In forming the mesh 10, only the pushing assemblies aligned with the selected longitudinal wires are activated and in a programmed sequence to effect the formation of the spacing furrs at the desired location in the selected wires 14 as previously described. For example, in the formation of the mesh 10 illustrated in the drawings, only the pushing assemblies aligned with wires 14*b*, 14*e* and 14*h* would be activated during the formation of the mesh and the spacing furrs 20*a*, 20*b* and 20*c* would be formed in successive indexing steps as above described. The sequence would then work until the desired length of self-forming mesh was formed. All of the welding head aligned with the longitudinal wires 14 would be activated so that each transverse wire is welded to each of the longitudinal wires.

As noted above, the present invention can comprise a wide variation of patterns embodying or at least substantially embodying the longitudinally and transversely staggered spacing furrs as well as variations in the configuration of the generally V-shaped furrs. Other forms of pushers, gripping assemblies and guides also could be employed in the formation of the furrs provided the pushing assemblies allow for the feeding of additional wire into the furrs during its formation as above described.

Figure 6:
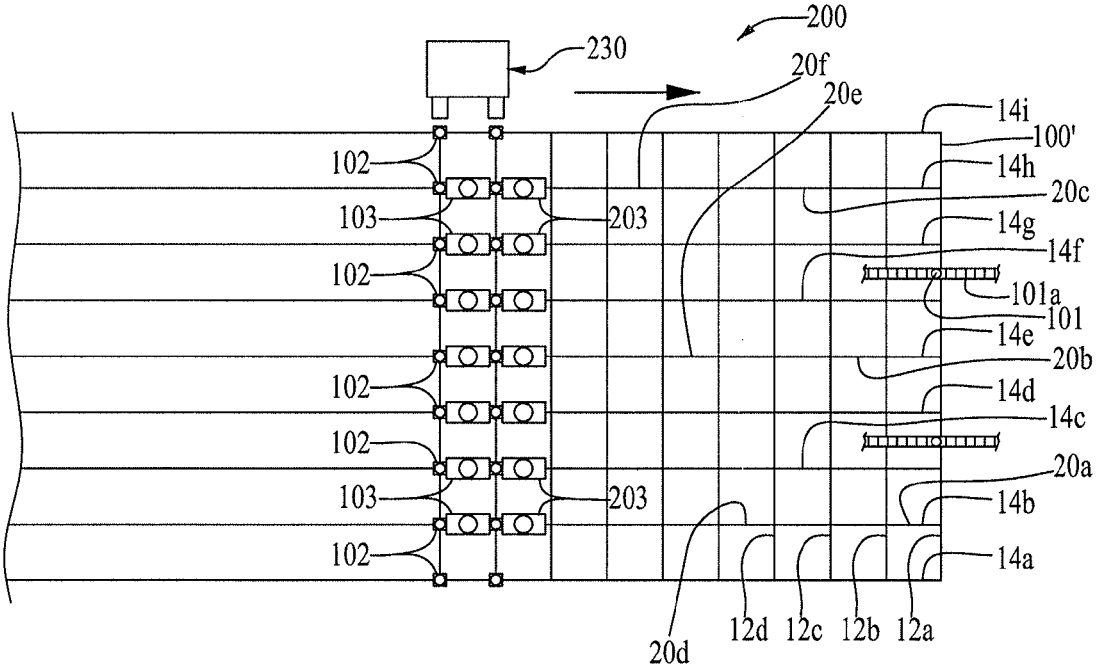
FIG. 6 is a schematic plan view of an alternate embodiment of a station for forming the self-furring welded wire mesh of the present invention.
Figure 7:
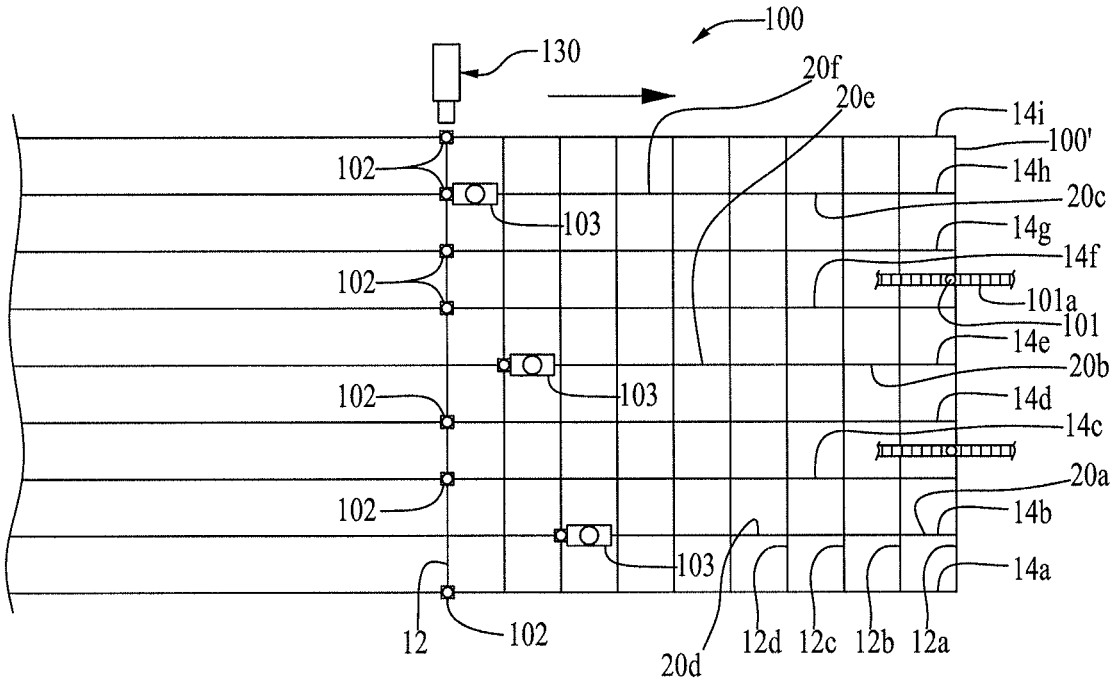
FIG. 7 is a schematic plan view of another alternate embodiment of a station for forming the self-furring welded wire mesh of the present invention.

An alternate embodiment of the forming station utilized in constructing the reinforcing method of the present invention is illustrated in FIG. 6. As seen therein, forming station 200 differs from the previously described station 100 in that station 200 is provided with a dual transverse wire feeding mechanism 230 and a second set of transversely aligned longitudinally adjacent pairs of welding heads 202 and pushing assemblies 203 positioned upstream of the similarly aligned pairs of welding heads 102 and pushing assemblies 103. As in forming station 100, the welding heads 202 and pushing assemblies 203 preferably are moveably mounted to accommodate variations in mesh size and wire spacings. The longitudinal spacing between the two sets of welding heads and pushing assemblies in forming station 200 also is preferably adjustable and is set to correspond with the spacing between the transverse wires in the mesh to be formed. In the configuration of forming station 200 employing a dual transverse wire feeding mechanism and two parallel sets of welding heads and pushing assemblies, a four- to six-inch spacing between wires is typical. A closer spacing of the wires would leave very little room for two sets of welding heads and pushing assemblies.

The operation station 200 is very similar to that described above with respect to forming station 100 except that the dual feeding mechanism 203 feeds two longitudinally spaced transverse wires onto the array of longitudinally extending wires as opposed to one. The two transverse wires are fed onto the array of longitudinal wires at a spacing equal to the distance between the wire intersections in the mesh to be formed. Also, the timing of the activation of the welding heads and pushing assemblies in one set is offset from the activation of the welding heads and pushing assemblies in a second set to prevent two associated pairs of welding heads and pushing assemblies from attempting to form spacing furrs in the same wire at the same time. If that were to occur, the upstream pushing assembly would be gripping the wire at the same time that the pusher in the downstream set was attempting to urge the wire outwardly and pull additional wire through the associated upstream guide into the forming V-shaped furr. The downstream pushing assembly would be unable to move the wire outwardly, jamming the forming station and/or breaking the wire. By offsetting the timing between the two sets of welding heads and pushing assemblies, multiple transverse wire feeder mechanisms could be employed. While two such sets are illustrated in FIG. 6, additional sets could be utilized so long as no more than one spacing furr was formed in any given wire at any given time.

In yet another variation of the forming station of the present invention, the longitudinally aligned pairs of welding heads and pushing assemblies are not transversely aligned as in the prior embodiments but are moveably mounted in a pattern corresponding to the pattern of spacing furrs in the mesh that is to be formed thereby. For example, to form the mesh 10 illustrated in FIG. 1, a set of longitudinally aligned pairs of welding heads and pushing assemblies could be positioned only adjacent to longitudinally extending wires 14*b*, 14*e* and 14*h* (the only wires having spacing furrs formed thereon) and the pairs of aligned welding heads and pushing assemblies would be positioned in an offset disposition corresponding to the locations of the spacing furrs that they would form. With the mesh 10 shown in FIG. 1, a single set of three offset aligned pairs of welding heads and pushing assemblies could be positioned adjacent to the locations of spacing furrs 20*a*, 20*b* and 20*c*. Alternately, two or more such offset sets of three pairs of welding heads and pushing assemblies could be similarly located adjacent to the selected longitudinal wires 14*b*, 14*e* and 14*h* at the positions where the furrs are to be formed in those wires. In such an embodiment, a suitable number of multiple wire feeding mechanisms would be employed to cooperate with the staggered array of welding heads and pushing assemblies in the formation of the mesh. Again, the timing of the activation of the sets of welding heads and pushing assemblies is set for that no more than one spacing furr is formed in a given longitudinally extending wire at any given time. Also, in the unselected longitudinally extending wires (the wires in which spacing furrs were not being formed), welding assemblies would still have to be positioned adjacent thereto to effect the welding of the wires 12 and 14 at each of the intersections thereof.

Various other changes and modifications may be made in carrying out the present invention without departing from the spirit and scope thereof. Insofar as said changes and modifications are within the purview of the appended claims, they are to be considered as part of the present invention.

What is claimed is:

1. A self-furring welded wire mesh for use in reinforcing a generally planar concrete and stucco structures of predetermined thickness, said mesh comprising:

a matrix of longitudinally and transversely extending wires, said wires defining intersections and said transversely extending wires being welded to said longitudinally extending wires at said intersections and wherein said longitudinally and transversely extending wires extend parallel to and are disposed about a first horizontal plane; and a selected plurality of said longitudinally extending wires each defining a plurality of V-shaped spacing furrs therein at predetermined spaced intervals therealong, said furrs extending perpendicular to said first plane and wherein lower end portions of said furrs are disposed in a second horizontal plane parallel to and spaced from said first plane a distance substantially equal to one half of a predetermined thickness of a concrete or stucco structure and wherein said selected plurality of longitudinally extending wires are of constant diameter and maintain said constant diameter as said wires transition into and from said spacing furrs along curvilinear paths and form said furrs without thinning said selected plurality of longitudinal wires adjacent to or along said furrs whereby weakening of said selected plurality of longitudinal wires in and adjacent to said spacing furrs is prevented and said spacing furrs in said selected longitudinally extending wires are located so as to be longitudinally and transversely staggered along said mesh.

2. The self-furring mesh of claim 1 wherein at least two of said longitudinally extending wires are devoid of any spacing furrs thereon and are disposed between each of the selected plurality of said longitudinally extending wires.

3. A self furring welded wire mesh for use in reinforcing generally planar concrete and stucco structures, said mesh comprising:

a matrix of longitudinally and transversely extending wires, said wires defining intersections and said transversely extending wires being welded to said longitudinally extending wires at said intersections and wherein said transversely and longitudinally extending wires extend parallel to and are disposed about a first horizontal plane; and a selected plurality of said longitudinally extending wires define a plurality of spacing furrs therein at predetermined spaced intervals along each of the selected wires, said furrs extending perpendicular to said first horizontal plane and wherein lower end portions of said furrs are disposed in a second horizontal plane parallel to and spaced from said first plane a distance equal to one half of a predetermined thickness of a concrete or stucco structure and wherein at least one longitudinally extending wire is devoid of said spacing furrs and is disposed between each of said selected longitudinally extending wires whereby said spacing furrs are transversely staggered, and wherein the spacing furrs in each of said selected longitudinally extending wires adjacent to each said longitudinally extending wire devoid of spacing furrs are not transversely aligned so as to be longitudinally staggered and at least one transversely extending wire is devoid of spacing furrs and is disposed between the spacing furrs in each of said selected longitudinally extending wires.

4. The self-furring mesh of claim 3 wherein said selected plurality of longitudinally extending wires are of constant diameter and maintain said constant diameter as said wires transition into and from said spacing furrs along curvilinear paths and form said furrs without thinning said selected plurality of longitudinal wires adjacent to and along said furrs whereby weakening of said selected plurality of longitudinal wires in and adjacent to said spacing furrs is prevented.

5. The self-furring mesh of claim 4 wherein at least two longitudinally extending wires devoid of said spacing furrs are disposed between each of said selected plurality of longitudinally extending wires.

6. The self-furring mesh of claim 3 wherein at least two longitudinally extending wires devoid of said spacing furrs are disposed between each of said selected plurality of longitudinally extending wires.

* * * * *